US008142373B1

(12) United States Patent
Riles

(10) Patent No.: US 8,142,373 B1
(45) Date of Patent: Mar. 27, 2012

(54) TEMPLE MASSAGING HEADBAND

(76) Inventor: Carol W. Riles, Ellenwood, GA (US)

( * ) Notice: Subject to any disclaimer, the term of this patent is extended or adjusted under 35 U.S.C. 154(b) by 1236 days.

(21) Appl. No.: 11/899,676

(22) Filed: Sep. 7, 2007

Related U.S. Application Data

(60) Provisional application No. 60/842,884, filed on Sep. 8, 2006.

(51) Int. Cl.
*A61H 1/00* (2006.01)
*A61H 11/00* (2006.01)

(52) U.S. Cl. ..... 601/71; 601/46; 601/48; 601/70; 601/79

(58) Field of Classification Search ..... 381/374, 381/379; 601/46, 67–70, 78–82, 84, 87, 601/93, 101, 136–138
See application file for complete search history.

(56) References Cited

U.S. PATENT DOCUMENTS 3,478,736 A * 11/1969 Roberts et al. ..... 601/71
4,175,551 A 11/1979 D'Haenens et al.
4,783,822 A * 11/1988 Toole et al. ..... 381/379
4,915,096 A 4/1990 Winstone et al.
D348,520 S 7/1994 Wolf
5,486,156 A 1/1996 Takach
5,611,771 A * 3/1997 Taylor ..... 601/70
5,792,174 A 8/1998 Ioan
D405,538 S 2/1999 Chih
6,179,794 B1 1/2001 Burras
6,228,041 B1 5/2001 Ameer
6,233,345 B1 * 5/2001 Urwyler ..... 381/381
6,575,923 B1 6/2003 Burras
7,153,283 B1 * 12/2006 Triolo et al. ..... 601/102
D605,172 S * 12/2009 Seade ..... D14/205
7,819,826 B2 * 10/2010 Diederich et al. ..... 601/3
2004/0133133 A1 * 7/2004 Dreimann et al. ..... 601/15

* cited by examiner

*Primary Examiner* — Kristen Matter
(74) *Attorney, Agent, or Firm* — Montgomery Patent & Design, LLC; Robert C. Montgomery; Joseph T. Yaksich

(57) ABSTRACT

A system and method that utilizes a massaging apparatus specifically for a person's temples with the expressed purpose of providing relaxation and headache relief, is herein disclosed. The apparatus is configured as a headband with battery-powered massagers at the temples. The apparatus is supported both with minimal elasticity from the headband and with ear supports. Power is supplied to the massagers from a rechargeable battery pack that can be worn about the arm or alternately the waist and is electrically tethered to the headband. Each small disc-shaped temple massager is separately powered by a small motor that produces the massaging effect which is intended to reproduce the sensation of rubbing/massaging the temples.

10 Claims, 6 Drawing Sheets

TEMPLE MASSAGING HEADBAND

RELATED APPLICATIONS

The present invention was first described in and claims the benefit of U.S. Provisional Application No. 60/842,884, filed Sep. 8, 2006, the entire disclosures of which are incorporated herein by reference.

FIELD OF THE INVENTION

The present invention relates generally to a unique system and massaging apparatus and, more particularly, to a headband to be worn around a person's head in the temple regions providing relaxation and headache relief by means of battery-powered massagers at the temples.

BACKGROUND OF THE INVENTION

Many people have found that relaxation is greatly enhanced by massaging a person's head around the temple regions. A direct and firm massage at the temples often reduces stress and strain, and possibly even alleviates headaches. It is difficult for a person to effectively massage their own temples.

Several attempts have been made in the past to provide an effective invention for massaging a user's temples in order to alleviate stress and related headaches. U.S. Pat. No. 4,175,551 in the name of D'Haenens discloses a massage device which utilizes the combination of electroneurological stimulation and mechanical massage for medical treatment of pain. The apparatus includes a housing having a massage head formed from a plurality of elongate rollers, connected to the electrical output of a pulse-generating circuit. The rollers form a mechanical massaging head, while the electrical pulses stimulate underlying nerves to block or reduce pain. A second or ground electrode is provided by an expansion band which can be easily slipped on an ankle or wrist and is connected to the main electrical circuit by a flexible electrical cord. The pulse-generating circuit includes a pair of switches for selecting a discrete voltage amplitude over a varying predetermined range, and a light-emitting diode to indicate operation of the pulse-generating circuit. Also included in the case or housing is a ball electrode for massaging and treating particular body points known as acupuncture or trigger points. The ball electrode is in the form of a roller ball installed in a ball socket in the housing, and is also connected to the output of the pulse-generating circuit. Unfortunately, this prior art example is not designed for alleviating the pain and strain caused specifically by headaches.

U.S. Pat. No. 5,486,156 in the name of Takach discloses a vibrating, form fitting skull cap which is designed to snugly fit a user. The inner portion of the cap presents a smooth continuous surface to the head while at the same time providing the capability of complex and subtle vibration patterns which may vibrate different areas differently. Suitable attachment points are provided on the outer portion of the cap to mount individual forced vibration generator units. Each vibration generator unit is separately controlled as to amplitude and frequency. The user may choose one or many of numerous available attachment points for the generators. Electrical controls are provided to fine tune the individual units. Numerous electrical power input alternatives are provided for flexibility of use. Pneumatic powered units may also be used to eliminate magnetic fields if necessary. Unfortunately, this prior art example is not designed to be discreetly worn in public.

U.S. Pat. No. 6,179,794 in the name of Burras describes a massaging head gear system that includes a headband with a substantially inverted U-shaped configuration. Also included is a pair of massaging assemblies coupled to ends of the headband. Next provided is a vibrating mechanism for vibrating the massaging assemblies and the headband. Unfortunately, this prior art example does not include a rechargeable battery.

None of the prior art particularly describes a headband to be worn around a person's head in the temple regions providing relaxation and headache relief by means of battery-powered massagers at the temples. Accordingly, there exists a need for a means to massage the temple area of the head in a mechanical fashion without the assistance of another person or the use of a person's own hands. The present invention satisfies such a need by providing a device that is convenient and easy to use, lightweight yet durable in design, and designed for providing relaxation and headache relief by means of battery-powered massagers at the temples. The temple massaging device reduces stress, strain and headaches and is designed for convenient use at work, home, or while traveling. The device is both portable and adjustable and includes a rechargeable battery. The present invention is simple to use, inexpensive, and designed for many years of repeated use.

SUMMARY OF THE INVENTION

In view of the foregoing disadvantages inherent in the prior art, it has been observed that there is need for a headband to be worn around a person's head in the temple regions providing relaxation and headache relief by means of battery-powered massagers at the temples.

The device is an apparatus to massage the temples of a person's head. It is intended to aid in relaxation and eliminate some headaches. The invention is of a general "U"-shape and is worn about the rear of the head such that the end of the "U"-shapes is positioned over the temple area of the wearer. Each end contains a small massaging disc that is powered by small individual motors with a set of watch batteries. These batteries along with a controller switch are provided. This massaging action is intended to reproduce the sensation of a temple massage by another individual. The invention is secured to the person's head with the aid of the headband which is readily adjustable. The use of the innovative apparatus and massaging system provides a relaxing temple massage at virtually any time and at almost any place.

A temple massaging device includes a massaging head assembly with a plurality of coextensively shaped flexible headbands positional about user ears respectively and a plurality of massaging units removably coupled to the headbands respectively for emulating a vibratory output signal directly to user temples. Such a massaging head assembly effectively includes an adjustment mechanism provided with a knob directly attached thereto, a plurality of hook portions medially formed along respective longitudinal lengths of the headbands respectively, and a pair of termination ends formed at proximal ends of the headbands respectively. Such a knob is selectively adaptable along clockwise and counter clockwise directions and thereby engages and conveniently disengages the termination ends such that the headbands are statically adapted to alternate positions about the user head. Distal ends of the headbands terminate at the adjustment mechanism and are operably mated thereto respectively. The headbands are centrally connected to each other at a rear base of the user head via the adjustment mechanism in such a manner that a spatial distance between the distal ends of the headbands is slidably adjustable along a longitudinal length of the adjustment mechanism.

The device further includes a support strap spaced from the headbands and includes a fastener for advantageously maintaining the support strap removably attached to a selected portion of a user body. Such a support strap includes a pocket formed along a longitudinal length thereof and facing outwardly from an exterior side of the support strap.

The device further includes a controller assembly detachably abutted against the support strap. Such a controller assembly includes a housing, a rechargeable battery pack stored within the housing, and a linearly slidable control switch operably coupled to the housing for effectively supplying direct current to the massaging head assembly.

The device further includes an electrical cord electrically connected to the controller assembly and to the massaging head assembly respectively. Such a cord conveniently forms a "Y"-shaped wiring configuration connected directly to respective ones of the headbands for providing a separate electrical output signal to the massaging units respectively. The controller assembly generates and transmits a regulated electrical current to the massaging units via the electrical cord based upon a user input.

The method for providing relaxation and headache relief includes the steps of: wrapping a support strap around a selected body portion of the user; placing a controller assembly within a pocket of the support strap; placing a plurality of headbands upon a user head such that a plurality of padded massaging units rest upon left and right temples of the user; placing a plurality of hook portions of the headbands over back peripheries of each user ear so as to cradle a junction of the user ears and the user head respectively; adjusting a spatial distance between the headbands by biasing a knob of an adjustment mechanism between clockwise and counter clockwise directions; and activating the massaging units to a desirable vibratory level by biasing a control switch on a controller assembly.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
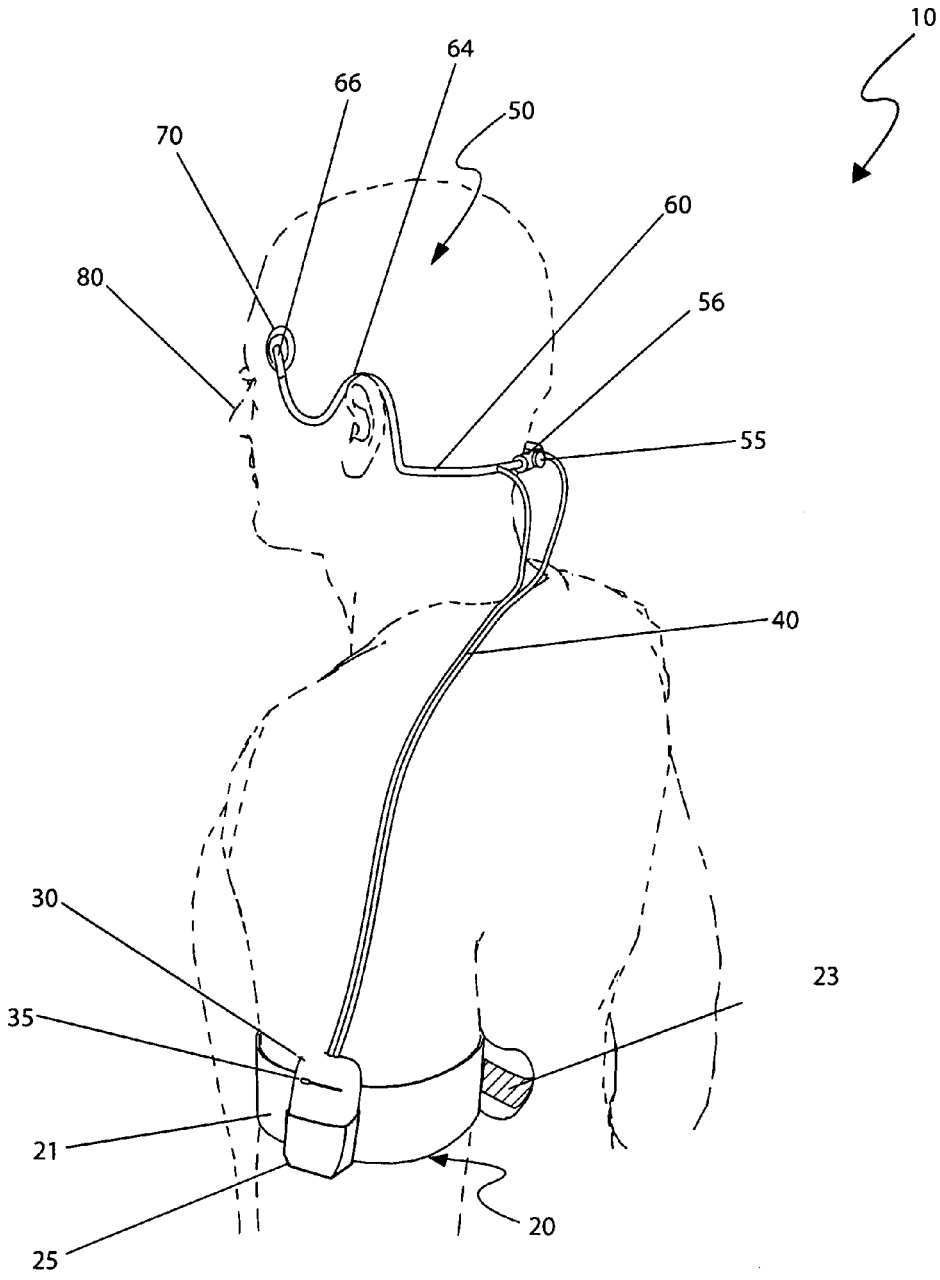
FIG. 1 is an environmental view of a temple massaging headband 10, according to a preferred embodiment of the present invention.

10 temple massaging headband
20 controller assembly
21 arm strap
22 waist strap
23 hook-and-loop strip
25 pocket
30 controller housing
35 control switch
36 battery compartment
40 electrical cord
50 massaging head assembly
56 adjustment mechanism
55 knob
60 first headband portion
61 second headband portion
64 first hook portion
65 second hook portion
66 first termination end
67 second termination end
70 first massaging unit
71 second massaging unit
80 user

DETAILED DESCRIPTION OF THE PREFERRED EMBODIMENT

Figure 3:
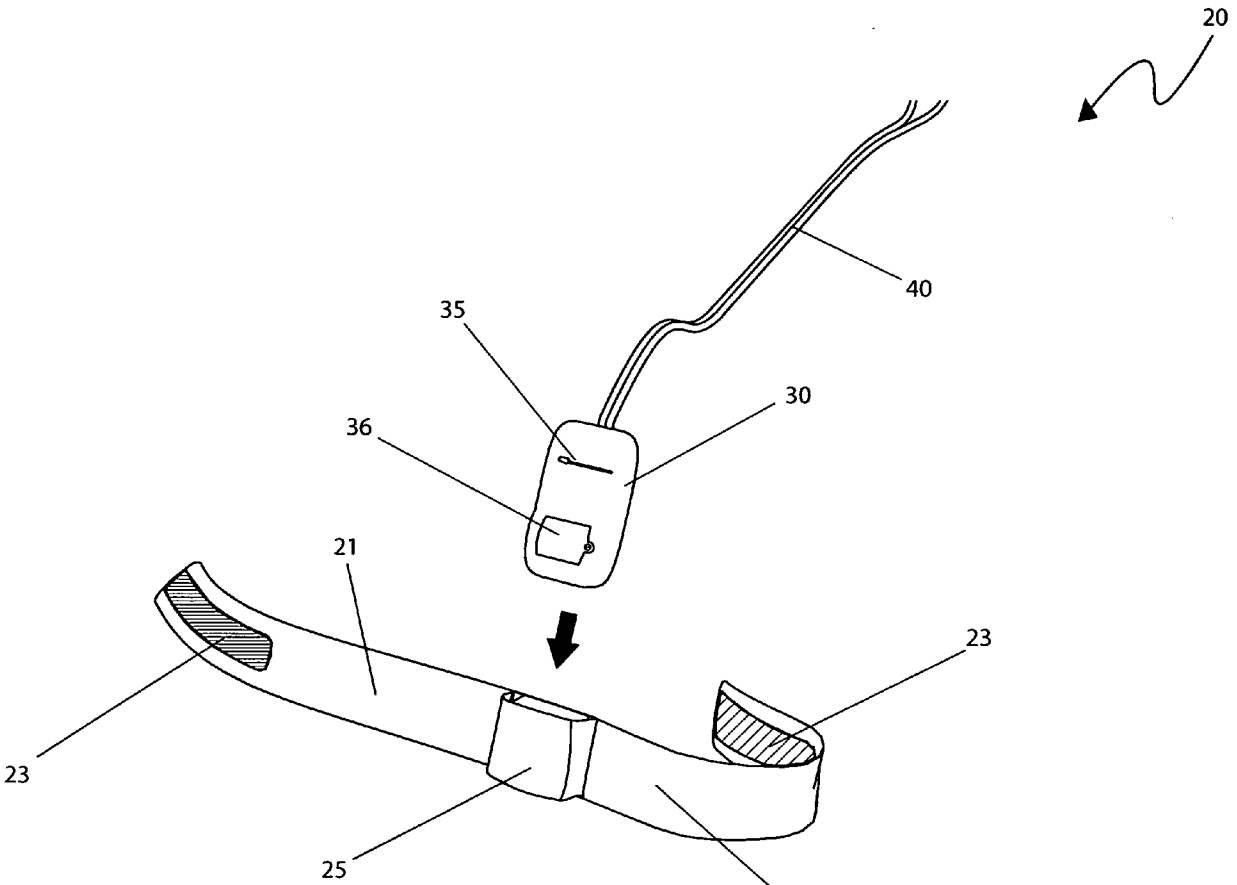
FIG. 3 is a perspective view of a controller assembly portion 20 of a temple massaging headband 10, according to a preferred embodiment of the present invention.
Figure 4A:
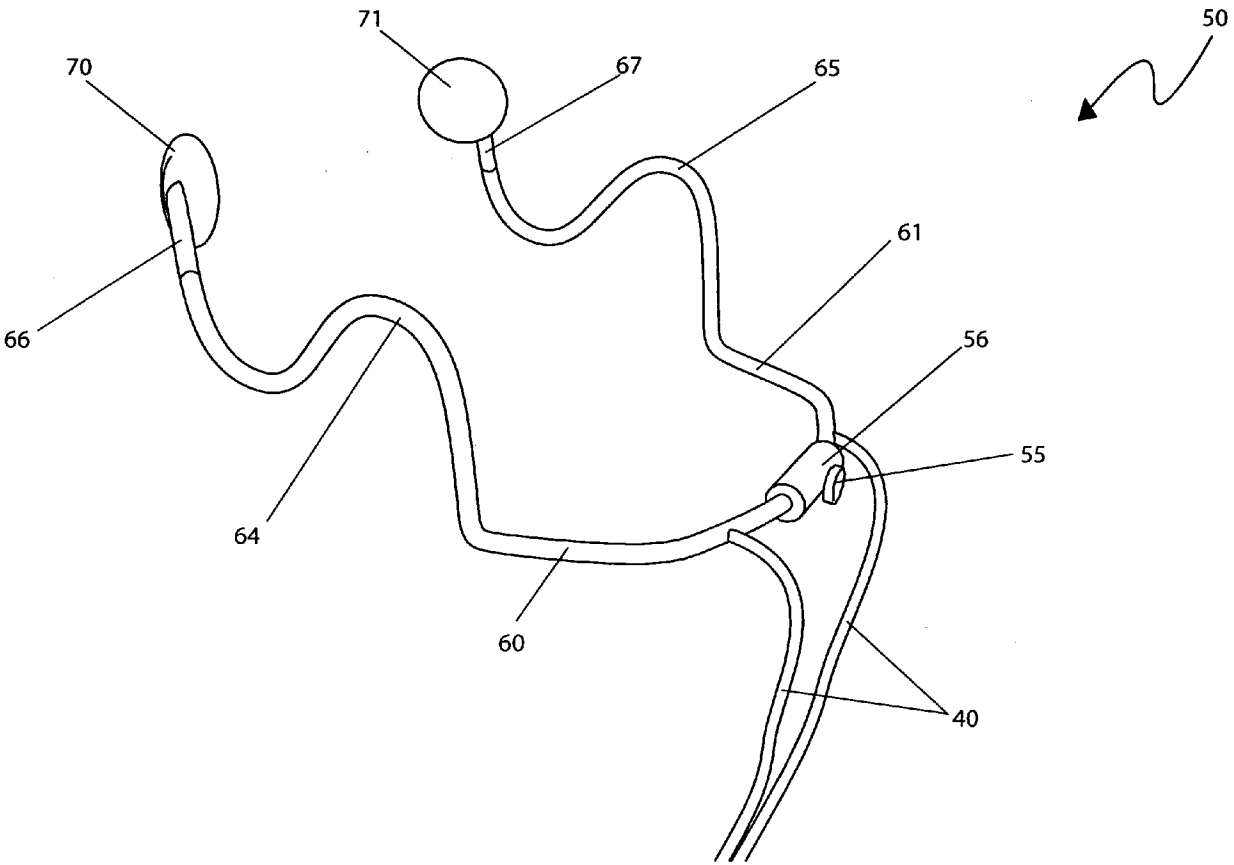
FIG. 4*a* is a perspective view of a massaging head assembly portion 50 of a temple massaging headband 10, according to a preferred embodiment of the present invention.
Figure 4B:
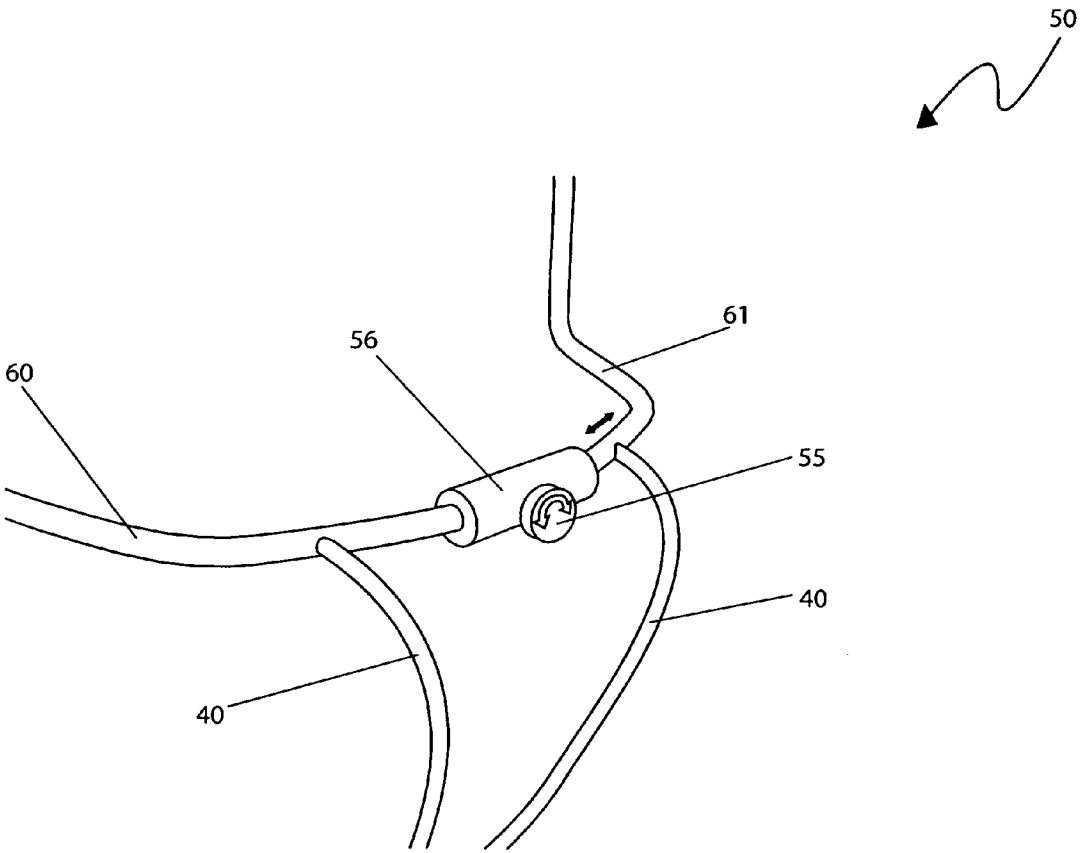
FIG. 4*b* is a close-up view of an adjustment mechanism portion 56 of a temple massaging headband 10, according to a preferred embodiment of the present invention; and, FIG. 5 is an environmental view of a temple massaging headband 10 depicting a waist mounted controller module 20 configuration, according to an alternate embodiment of the present invention.
Figure 5:
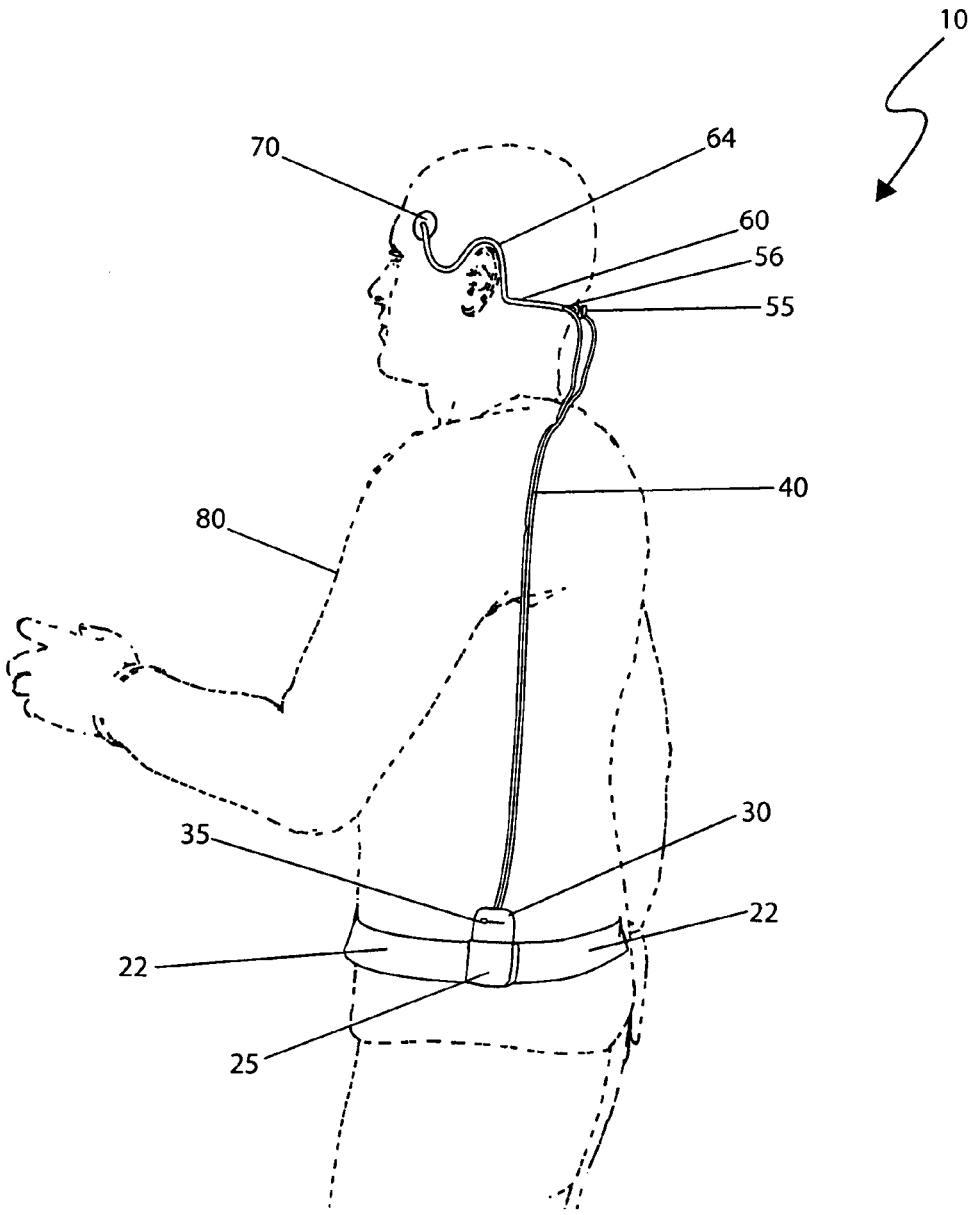

The best mode for carrying out the invention is presented in terms of its preferred embodiment, herein depicted within FIGS. 1 through 4*b* and depicted in an alternate embodiment in FIG. 5. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a temple massaging headband (herein described as the "apparatus") 10, which provides a means for a system and method for massaging a person's temples providing relaxation and headache relief. The apparatus 10 comprises a headband 60 with battery-powered massaging units 70, 71 at the temples. Power is supplied to the massaging units 70, 71 from a rechargeable battery pack 36 which can be worn about the arm 21 or alternately the waist 22, and is electrically tethered 40 to the headband 60.

Referring now to FIG. 1, an environmental view of the apparatus 10, according to the preferred embodiment of the present invention, is disclosed. The apparatus 10 is depicted here being worn upon a user's head and arm portions 80. The apparatus 10 comprises a massaging head assembly 50 further comprising a flexible first headband portion 60 (only one side illustrated here) which provides a form-fitting design around a user's ear 80 providing a positioning means to a pair of massaging units 70, 71 at a user's two (2) temple regions 80. The massaging units 70, 71 emulate manual stimulation thereupon said user's temples 80 providing effective relaxation and headache relief.

The apparatus 10 further comprises an arm strap 21 shown here comprising a sewn assembly of elastic strapping material and hook-and-loop fasteners 23. The hook-and-loop fasteners 23 are attached thereto an inward side thereof each end to operably provide an adjustable means for most arm sizes and attached thereto in place by compatibility placing one strap 21 over the other to acquire proper attachment thereof. However, other attachment means for the arm strap 21 may be provided using other type fastening devices such as clips, fasteners, buckles, buttons, latches, or the like without deviating from the basic concept and as such should not be interpreted as a limiting factor of the present invention 10. The arm strap 21 is envisioned to be provided in a variety of colors and patterns.

Figure 2:
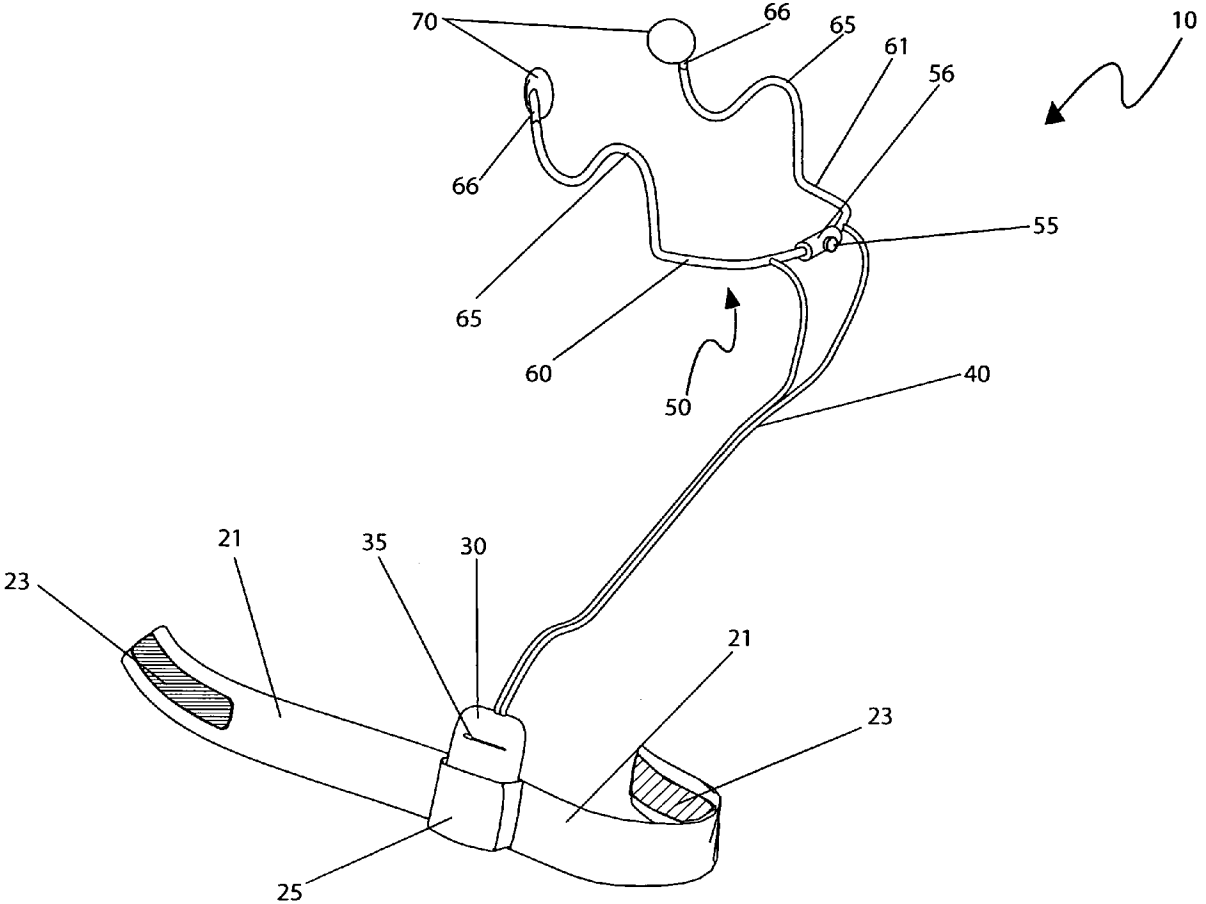
FIG. 2 is a perspective view of a temple massaging headband 10, according to a preferred embodiment of the present invention.

Referring now to FIG. 2, a perspective view of the apparatus 10, according to the preferred embodiment of the present invention, is disclosed. The apparatus 10 comprises a controller assembly 20, a massaging head assembly 50, and an electrical cord 40. The controller assembly 20 further comprises a controller housing 30 which provides an enclosure to electrical and electronic components and devices which provide a regulated electrical current to the "U"-shaped massaging head assembly 50 via the electrical cord 40. The flexible electric cord 40 travels upwardly thereto the massaging head assembly 50 defining a conduit that resides in interaction with an open back face for operably receiving said cord 40. The cord 40 travels therethrough said conduit residing within said massaging head assembly 50 to power two (2) massaging units 70, 71 being mounted thereat a forward location. The cord 40 is directly connected thereto the massaging assemblies 70, 71, thereby providing electrical power.

Referring now to FIG. 3, a perspective view of a controller assembly portion 20 of the apparatus 10, according to the preferred embodiment of the present invention, is disclosed. The apparatus comprises an arm strap 21, a pair of hook-and-loop fasteners 23, a pocket 25, a controller housing 30, a control switch 35, a battery compartment 36, and an electrical cord 40.

The arm strap 21 provides an attachment means thereto a user's arm 80 being affixed therearound the user's upper arm region 80. The arm strap 21 is envisioned to be made using a sewn assembly of common textile materials and further comprising a sewn-in pocket 25 of like materials along an intermediate outer surface extending outwardly and receivably holding the controller housing 30 therein. The controller housing 30 provides a miniature rectangular-shaped protective and self-sealing enclosure to internal electrical and electronic components therein. The controller housing 30 also provides user 80 accessible features including a control switch 35 and a battery compartment 36 along a front surface thereupon. The controller assembly 20 is envisioned to supply and deliver direct current (DC) power to the massaging head assembly 50, preferably from a rechargeable battery pack therewithin said battery compartment 36 and to be electrically tethered to the massaging head assembly 50 via the electrical cord 40. The control switch 35 is envisioned to be incorporated therein said controller housing 30 to provide control functionality such as amplitude and frequency variation thereby. It is also envisioned that said control switch 35 integrally regulate and disperse the energization extent in intervals thereto the aforementioned massaging units 70, 71 (see FIG. 4*a*). The control switch 35 is envisioned to be a linear sliding variable voltage device common in the industry providing a digit activated button thereupon in an expected manner. It is also envisioned that the control switch 35 provides a convenient ON/OFF function to the apparatus 10 thereat a particular extent of the control switch 35 sliding motion.

Referring now to FIGS. 4*a* and 4*b*, a perspective and close-up view of a massaging head assembly portion 50 of the apparatus 10, according to the preferred embodiment of the present invention, are disclosed. The apparatus 10 comprises an electrical cord 40, an adjustment mechanism 56, a knob 55, a first headband portion 60, a second headband portion 61, a pair of hook portions 64, 65, a pair of termination ends 66, 67, and a pair of massaging units 70, 71. The apparatus 10 conducts a regulated DC current to the massaging head assembly 50 being dispersed therethrough the electrical cord 40 comprising a pair of conducting wires being electrically and adaptably connected therewith the headband portions 60, 61 forming a "Y"-shaped wiring configuration providing a separate energizing means to each massaging unit 70, 71. The massaging head assembly portion 50 comprises a spring tensioned "U"-shaped device having arcuate tubular headband portions 60, 61 having particular features for adjustably engaging one another behind the user's head 80 via the adjustment mechanism 56 and the knob 55.

The headband portions 60, 61 are centrally connected thereto each other at a rear base of the user's head via a central adjustment mechanism 56. The headband portions 60, 61 are adaptably constructed to operably cooperate with each other in securing the ends together therewithin the adjustment mechanism 56 so as to provide width adjustably providing slidably lengthening properties. The adjustable mechanism 56 comprises a knob 55 providing a clamping means thereupon said headband portions 60, 61. Once said headband portions 60, 61 are moved inwardly or outwardly therein the adjustable mechanism 56 to a desired distance, the knob 55 may be turned in a clock-wise direction to secure said headband portions 60, 61 in desired positions.

The headband portions 60, 61 are envisioned to be fabricated of a soft and pliable material such as plastic that is readily adjustable to expand or contract in accordance to the contour of the user's head 80. The headband portions 60, 61 are envisioned to comprise a pair of opened-loop or hook portions 64, 65 being ergonomically tailored inverted "U"-shaped features to cradle the back periphery of the user's ears 80 along the junction of where the ear convenes therewith the head of a user 80. Each hook portion 64, 65 provides support without significant resilient deformation in a similar manner as common eyeglasses, thereby providing a stabilizing and positioning means to the massaging head assembly 50 upon a user's head. The hook portions 64, 65 are symmetrically located on both sides of the headband portion 60 terminating at the user's temple thereof and extending forwardly being attached thereto a pair of terminating ends 66, 67.

The terminating ends 66, 67 of the headbands 60, 61 provide an attachment means to accommodatingly mount a pair of massaging units 70, 71 one (1) on each headband member 60, 61. The termination ends 66, 67 are envisioned to comprise integral press-fit or threaded fastening features thereto the headband portions 60, 61 providing easy removal of the massaging units 70, 71 for cleaning, replacement, or the like. The massaging units 70, 71 are substantially the same each having foam rubber padded outer surfaces resting on the user's left and right temple 80 thereof. The massaging units 70, 71 preferably comprise a mechanical type vibrating device employing a rotary vibrating motor similar to those used in cell phones being common in the industry; however, other types of vibration devices such as electromagnetic devices or the like, may be provided and as such should not be interpreted as a limiting factor of the present invention 10. The massaging units 70, 71 are envisioned to provide a vertical vibrating amplitude within parallel planes thereto one another and about a common horizontal axis being perpendicular to said terminating ends 66, 67. However, it is further envisioned that said massaging units 70, 71 may provide a variety of different vibration effects such as various frequencies, various amplitude ranges, alternate vibration directions, and the like, and as such should not be interpreted as a limiting factor of the present invention 10.

Now referring to FIG. 5, an environmental view of the apparatus 10 depicting a waist mounted controller module 20 configuration, according to an alternate embodiment of the present invention, is disclosed. The waist mounted controller module 20 comprises a waist strap 22 being similar in construction and function as the preferred embodiment arm strap 21; however, providing an extended length thereof. The waist strap 22 is envisioned to be introduced in a variety of strap lengths corresponding to users having different waistline sizes. The waist strap 22 is further envisioned to be provided in a variety of colors and patterns.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of utilizing the apparatus 10 may be achieved by performing the following steps: affixing the apparatus 10 properly by wrapping the arm strap 21 around the user's arm 80 such that the hook-and-loop fasteners 23 being affixed separately thereto each end of the arm strap 21 to correspondingly attach to each other; positionably placing the headband portions 60, 61 thereupon the user's head 80 such that the padded massaging units 70, 71 are rested thereupon the user's left and right temples 80; placing the hook portions 64, 65 over the back periphery of each user's ear 80 so as to cradle the junction of said ears 80 where they convene therewith the head 80; adjusting the headband portions 60, 61 by utilizing the adjustment mechanism 56; adjusting a width therebetween the headband portions 60, 61 to a desired position utilizing the knob 55; energizing the apparatus 10 to a desirable vibratory level utilizing the control switch 35 to adjustably distribute DC current from the batteries 36 thereto the massaging units 70, 71; turning off the apparatus 10 when concluding a massage treatment by slidingly moving the control switch 35 to the extreme OFF position; removing the apparatus 10 therefrom the user's head 80; storing the apparatus 10 accordingly; and, benefiting from the portability of the invention 10 while at home, work, or traveling as well as eliminating hand and finger fatigue associated with manually massaging one's temples 80.

The method of utilizing the alternate waist mounted controller module 20 configuration may be achieved by performing the following additional steps: affixing the controller module portion 20 of the apparatus 10 thereto a user 80 by wrapping the waist strap 22 around the user's waist region 80 such that the hook-and-loop fasteners 23 being affixed separately thereto each end of the waist strap 21 to correspondingly attach to each other; and, utilizing and benefiting from the apparatus 10 as described above.

The headband portions 60, 61 are configured to engage the user's head contour 80; provide a hook portion 64, 65 to engage the user's ears 80; and to terminate at the temples 80 thereof. The massaging units 70, 71 are mounted thereupon the terminating end 66, 67 of said headband portions 60, 61 so as to rest thereupon the user's temples 80. The massaging units 70, 71 having a vibrating motor therewithin each respectively, are enclosed therewith a padded foam rubber disc-like cushion to reproduce the sensation of rubbing and massaging the temples and stimulating the skin and nerves throughout the temple region, as well as massaging the muscles in that region, to aid in relaxation and possible relief of headaches. Internal batteries therein the battery compartment 36 eliminate additional tethering to stationary power sources, thereby permitting a user 80 to move about during the massaging experience.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A temple massaging device for providing relaxation and headache relief, said temple massaging device comprising:

a massaging head assembly comprising:

a plurality of flexible headband portions positional about user ears respectively, and, a plurality of massaging units coupled to said headband portions respectively for emulating a vibratory output signal directly to user temples;

a support strap spaced from said headband portions and including a fastener for maintaining said support strap removably attached to a selected portion of a user body;

a controller assembly; and, an electrical cord electrically connected to said controller assembly and to said massaging head assembly respectively;

wherein said controller assembly generates and transmits a regulated electrical current to said massaging units via said electrical cord based upon a user input;

wherein said controller assembly is located external of said massaging units;

wherein said massaging head assembly comprises an adjustment mechanism provided with a knob directly attached thereto;

a plurality of hook portions medially formed along respective longitudinal lengths of said headband portions respectively; and, a pair of termination ends formed at proximal ends of said headband portions respectively;

wherein said knob is selectively adaptable along clockwise and counter clockwise directions and thereby engages and disengages said termination ends such that said headband portions are statically adapted to alternate positions about the user head;

wherein said cord forms a "Y"-shaped wiring configuration connected directly to a respective one of said headband portions for providing a separate electrical output signal to said massaging units respectively;

wherein said adjustment mechanism is intermediately spaced between said "Y"-shaped wiring configuration such that distal most ends of said "Y"-shaped wiring configuration remain spaced from said adjustment mechanism as said headband portions are laterally adjusted relative to said adjustment mechanism;

wherein each said hook portion is adapted to be positioned about a user ear, wherein each said headband portion further has a curvilinear region contiguously extending forward from said hook portions, wherein each said hook portions further has a crest located at a top of the user ear and each said curvilinear region has a trough located subjacent to the user ear;

wherein said termination ends are disposed at a forward-most portion of said curvilinear regions respectively; and, wherein said massaging units are directly connected to said termination ends of said headband portions respectively.

2. The temple massaging device of claim 1, wherein said support strap comprises:

a pocket formed along a longitudinal length thereof and facing outwardly from an exterior side of said support strap.

3. The temple massaging device of claim 1, wherein said controller assembly comprises:

a housing;

a rechargeable battery pack stored within said housing; and, a linearly slidable control switch operably coupled to said housing for supplying direct current to the massaging head assembly.

4. The temple massaging device of claim 1, wherein distal ends of said headband portions terminate at said adjustment mechanism and are operably mated thereto respectively.

5. The temple massaging device of claim 4, wherein said headband portions are centrally connected to each other at a rear base of the user head via said adjustment mechanism in such a manner that a spatial distance between said distal ends of said headband portions is slidably adjustable along a longitudinal length of said adjustment mechanism.

6. A temple massaging device for providing relaxation and headache relief, said temple massaging device comprising:

a massaging head assembly comprising:

a plurality of coextensively shaped flexible headband portions positional about user ears respectively, and, a plurality of massaging units removably coupled to said headband portions respectively for emulating a vibratory output signal directly to user temples;

a support strap spaced from said headband portions and including a fastener for maintaining said support strap removably attached to a selected portion of a user body;

a controller assembly detachably abutted against said support strap; and, an electrical cord electrically connected to said controller assembly and to said massaging head assembly respectively;

wherein said controller assembly generates and transmits a regulated electrical current to said massaging units via said electrical cord based upon a user input;

wherein said controller assembly is located external of said massaging units;

wherein said massaging head assembly comprises an adjustment mechanism provided with a knob directly attached thereto;

a plurality of hook portions medially formed along respective longitudinal lengths of said headband portions respectively; and, a pair of termination ends formed at proximal ends of said headband portions respectively;

wherein said knob is selectively adaptable along clockwise and counter clockwise directions and thereby engages and disengages said termination ends such that said headband portions are statically adapted to alternate positions about the user head;

wherein said cord forms a "Y"-shaped wiring configuration connected directly to a respective one of said headband portions for providing a separate electrical output signal to said massaging units respectively;

wherein said adjustment mechanism is intermediately spaced between said "Y"-shaped wiring configuration such that distal most ends of said "Y"-shaped wiring configuration remain spaced from said adjustment mechanism as said headband portions are laterally adjusted relative to said adjustment mechanism;

wherein each said hook portion is adapted to be positioned about a user ear, wherein each said headband portion further has a curvilinear region contiguously extending forward from said hook portions, wherein each said hook portions further has a crest located at a top of the user ear and each said curvilinear region has a trough located subjacent to the user ear;

wherein said termination ends are disposed at a forward-most portion of said curvilinear regions respectively; and, wherein said massaging units are directly connected to said termination ends of said headband portions respectively.

7. The temple massaging device of claim 6, wherein said support strap comprises:

a pocket formed along a longitudinal length thereof and facing outwardly from an exterior side of said support strap.

8. The temple massaging device of claim 6, wherein said controller assembly comprises:

a housing;

a rechargeable battery pack stored within said housing; and, a linearly slidable control switch operably coupled to said housing for supplying direct current to the massaging head assembly.

9. The temple massaging device of claim 6, wherein distal ends of said headband portions terminate at said adjustment mechanism and are operably mated thereto respectively.

10. The temple massaging device of claim 9, wherein said headband portions are centrally connected to each other at a rear base of the user head via said adjustment mechanism in such a manner that a spatial distance between said distal ends of said headband portions is slidably adjustable along a longitudinal length of said adjustment mechanism.

* * * * *